US005341931A

United States Patent [19]

Prochaska et al.

[11] Patent Number: 5,341,931

[45] Date of Patent: Aug. 30, 1994

[54] PACKAGE LINER FOR RECTANGULAR OBJECT

[76] Inventors: Gerhard W. Prochaska, 1 Appleby Court, Islington, Ontario, Canada, M9B 5A1; Edwin F. Southam, 155 Balliol St. P.H.2, Toronto Ontario, Canada, M4S 1C4

[21] Appl. No.: 79,567

[22] Filed: Jun. 22, 1993

[51] Int. Cl.[5] ..... B65D 85/30; B65D 81/02

[52] U.S. Cl. ..... 206/485; 206/45.19; 206/387; 206/590; 206/592

[58] Field of Search ..... 206/588–594, 206/521, 424, 387, 45.14, 485, 45.19

[56] References Cited

U.S. PATENT DOCUMENTS

| | | | |
|---|---|---|---|
| 2,410,591 | 11/1946 | Turner | 206/586 |
| 3,220,632 | 11/1965 | Persson | 206/521 |
| 3,516,593 | 6/1970 | Larsen | 206/424 |
| 4,146,127 | 3/1979 | Bayer | 206/45.14 |
| 4,230,258 | 10/1980 | Lane | 206/589 X |
| 4,438,848 | 3/1984 | Montealegre et al. | 206/588 |

FOREIGN PATENT DOCUMENTS

| | | | |
|---|---|---|---|
| 273276 | 5/1951 | France | 206/485 |
| 701212 | 12/1953 | France | 206/485 |
| 1114066 | 12/1955 | France | 206/485 |
| 0124585 | 5/1989 | Japan | 206/387 |
| 393630 | 6/1933 | United Kingdom | 206/485 |

*Primary Examiner*—Bryon P. Gehman

[57] ABSTRACT

A packaging liner for use in association with objects of pre-determined length, breadth and depth, for holding at least one object in a secure manner, and having a back panel defining a length greater than the length of the object, and defining a width greater than the width of the object, end panels on each end of the back panel, partial panels connected to the end panels to overlie portions of the back panel, glue flaps on the ends of the partial panels, glued in pre-determined locations to the back panel, to secure the partial panels to the back panel, the partial panels and the back panel defining two parallel spaced apart respective chambers shaped and dimensioned to receive respective objects, and, foldable panels in each of the partial panels, the foldable panel being adapted to be folded to define open sided recesses, each of the recesses having a width equal to the width of an object, and defining a length less than that of an object, so as to receive a single object therein.

10 Claims, 5 Drawing Sheets

FIG. 1
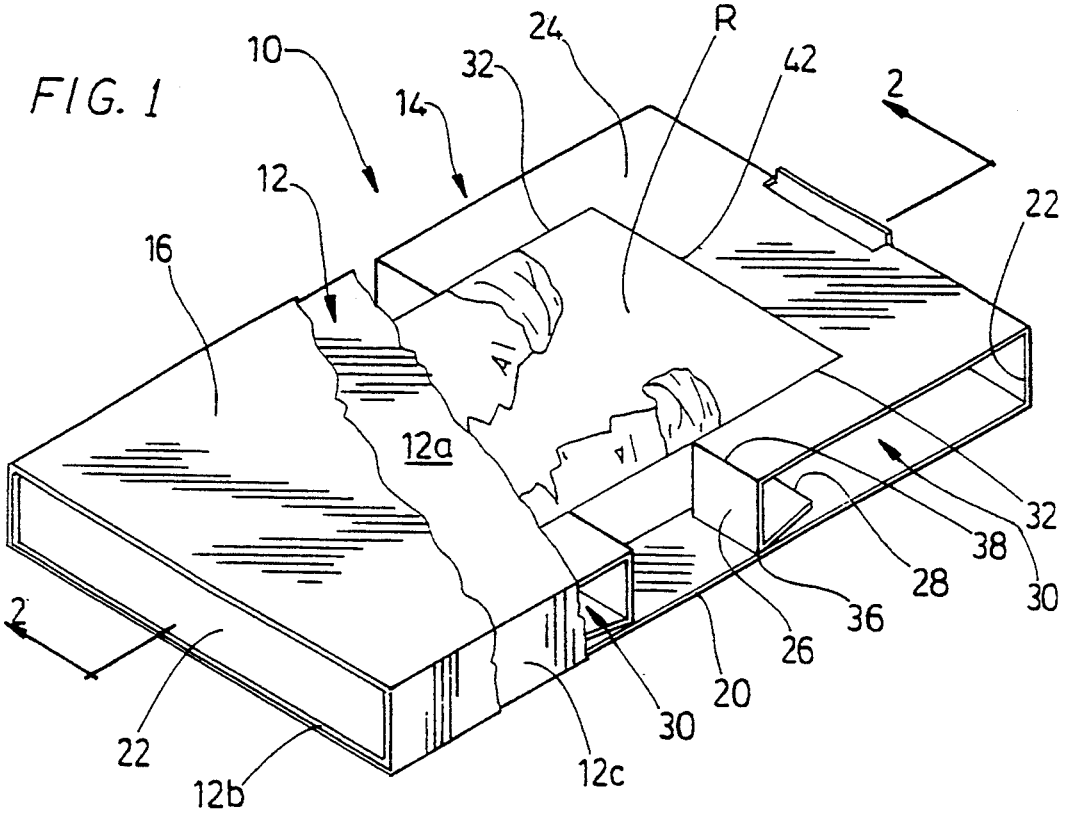
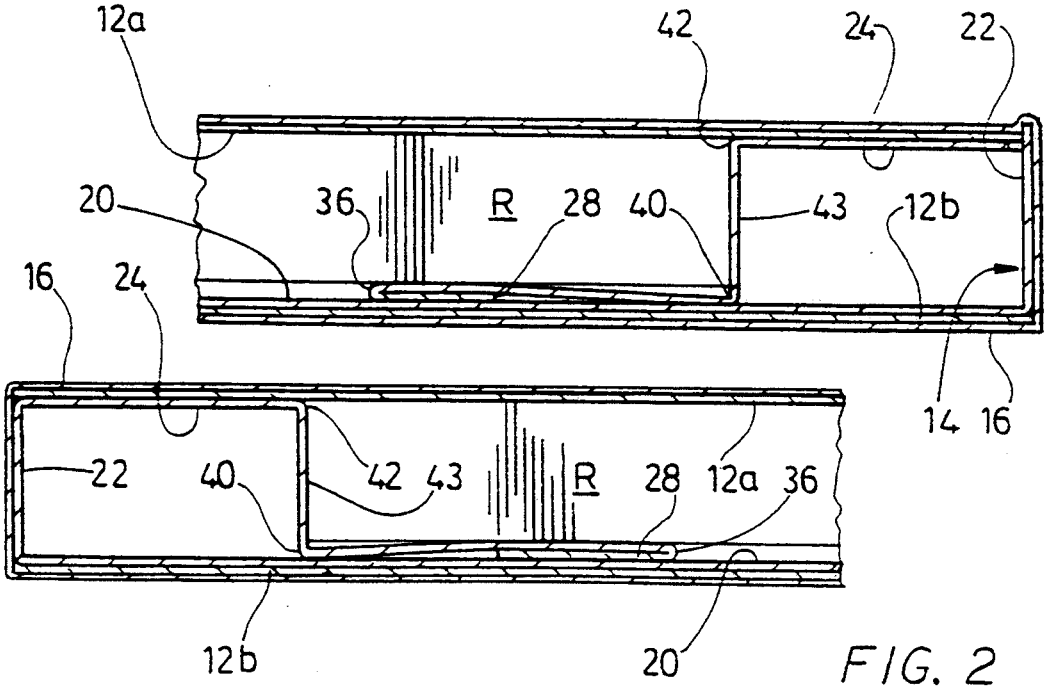
FIG. 2

PACKAGE LINER FOR RECTANGULAR OBJECT

FIELD OF THE INVENTION

The invention relates to packaging, and in particular to a package having a liner for receiving a single rectangular object, or a plurality of such rectangular objects, and having an outer sleeve for enclosing said liner.

BACKGROUND OF THE INVENTION

In the packaging art, it is not unusual to require packages which may contain either a single object or, a plurality of such objects, depending upon the manufacturers' sales policy and pricing and the manner in which the products are sold. Sometimes the products are sold singly, sometimes in pairs, sometimes in groups of three or even four.

In the great majority of cases, manufacturers of such products find it necessary to provide specific packages for each product, or multiples of products. This means that packages must be designed either for a single product or for multiples of the product. Separate packages must then be printed up, and the packages must then be assembled with the appropriate products for distribution and sale.

The design and printing of packaging is one of the significant features in the success of the sale of the particular product. Great care, and expense, is involved in designing, manufacturing, and printing an appealing package.

In the particular case of packages containing recordings of audio or visual material, the packaging must be printed up with information specific to the audio or visual recording contained in the package. The aesthetic appeal of such packaging design, and also the amount of detailed information carried on it, all have a significant effect on the successful selling of that product. In the case of such audio and visual recorded material, typically being for example, audio cassette tapes, there is an enormous variety of different material which is published and distributed from time-to-time. Such material ranges from popular music, classical music, fiction and non-fiction, theatrical works, and a wide variety of other audio material which may be recorded and sold at various times.

Tapes in particular may be sold either singly or in pairs or in groups of three or four, depending upon the length and extent of the work being published and sold.

In order to control costs, it is therefore desirable that as far as possible, the printing of such information shall be printed on exterior material which is relatively inexpensive, and can be produced in appropriate numbers at short notice.

On the other hand, in order to permit the use of packaging which can be manufactured in large bulk volumes, to reduce its cost, it is desirable that a liner or interior package may be produced without such printing, and thus may be manufactured in large bulk volume, and stored and used for packaging any work which may be desired to be published on such audio tapes. It is also preferable that such packaging shall be at least adaptable as between packaging for one and two such tapes in the one hand, and as between packaging for three and four such tapes on the other hand. By making such interior liners for such packaging adaptable in this way, and free of printing, it is possible to manufacture them in much larger bulk quantities, for a given time period, and thus reduce the cost of the liners.

In addition to the foregoing, it is also found to be desirable that such liners or interior packages shall be formed in such a way as to securely grip the rectangular objects, in this case, audio cassette boxes, so that they do not shake or move within the package. In practice, this is not always easy to do in the cardboard packaging art. This material is not such that it exhibits any inherent resiliency which might apply an elastic or squeezing pressure to the rectangular object. It is found therefore, that it is somewhat difficult to achieve a tight grip on a rectangular object with a package made of card stock.

A further problem related to the packaging of rectangular objects, particularly when they are relatively small and of relatively considerable value, such as audio cassette tapes, is the matter of in-store display, convenience of selection for purchasers, reducing as far as possible losses due to pilfering, or simply objects becoming mislaid, and also, in-store labelling for pricing inventory control and the like.

In the case of relatively small objects such as audio cassettes, which have a relatively considerable value in relation to their size, all of these problems of in-store control and handling are particularly aggravated. Various different types of in-store packaging systems have been proposed and used in the past, in which larger cardboard packages are used to display audio cassette tapes, and in which customers will carry their purchases to the cash register. In many cases, at the cash register, the store clerk will then remove the cassette tape from the package and the package is then refilled with another tape and placed back on the display. In other cases, the package simply remains packed around the tape, until the customer takes it home. The use of such oversize packages renders problems of handling within the store, somewhat simpler. Larger packaging can easily carry in-store labels giving price information, inventory information and having bar codes printed thereon and the like. Most of these systems are however, used as in-store aids by retailers. Consequently, the retail staff in the store must spend considerable time repackaging objects, such as cassette tapes, in packages in which they are then displayed for sale. Clearly, it is desirable that assuming such oversized packaging is to be used, that it shall be applied by the manufacturer rather than the individual retail outlets. In this way, the economies of large volume manufacture of such packaging and large run printing, can be obtained to the maximum, and at the same time the staff in each retail store will be able to concentrate exclusively on sales.

BRIEF SUMMARY OF THE INVENTION

With a view to achieving an improvement in the foregoing, the invention comprises a packaging liner for use in association with objects of pre-determined length, breadth and depth, for holding at least one said object in a secure manner, and comprising, a back panel defining a length greater than the length of a said object, and defining a width greater than the width of said object, end panel means on each end of said back panel, partial panels connected to said end panel means, and adapted to overlie portions of said back panel, glue flap means on the ends of said partial panels, and adapted to be glued in pre-determined locations to said back panel, whereby to secure said partial panels in said overlying relation over said back panel, said partial panels and said back panel defining two parallel spaced apart respective chambers each of said respective chambers being shaped and dimensioned to receive a respective said object therein, and, foldable panel portions in each of said partial panels, said foldable panel portions being adapted to be folded to define respective open sided recesses, each of said recesses defining a width equal to the width of a said object, and defining a length less than that of a said object, whereby portions of one said object may be received in respective said infolded recesses, and secured therein.

The invention further comprises such a packaging liner, and including partial wall panels connected to said partial panels and to said glue flap means, and fold lines between said back panel and said end panel means and said end panel means and said partial panels and between said partial panels and said partial glue flap means, whereby the same may be stored in a substantially flat extended condition, and whereby folding along said fold lines will set up said liner for use as aforesaid.

The invention further comprises such a packaging liner, wherein said partial panels define a predetermined length and breadth, and wherein said glue flaps are glued to said back panel and predetermined distance from said end panel means, said predetermined distance being less than said length of said partial panels. The invention further comprises such a packaging liner, and wherein each of said partial panels and their respective end panel means and wall panels define respective chambers, each of said chambers extending transversely relative to said back panel, in parallel spaced apart relation and being of rectangular cross-section.

The invention further comprises such a packaging liner, and wherein said recesses are of open sided rectangular shape, and wherein each recess defines an end, said ends being spaced apart a distance less than the length of a said object.

The invention further comprises such a packaging liner and wherein each said foldable panel portion defines spaced apart parallel side cuts, said side cuts extended longitudinally with respect to said back panel, and a plurality of fold lines extending between said side cuts, generally normal thereto.

The invention further comprises such a packaging liner and wherein said foldable panels and said side cuts and said transverse fold lines define fold bottom walls, and fold end walls, said fold end walls being connected to said partial panels, and said fold bottom walls being connected to said glue flap means.

The invention further comprises such a packaging liner and including four said partial panels connected to respective said end panel means, and respective glue flap means therefor, each of said partial panels defining respective said chambers, whereby said packaging liner may receive at least three said objects.

The invention further comprises such a packaging liner wherein at least two of said four partial panels define respective foldable panel portions, being adapted to be folded to define respective open sided recesses whereby a said object may be received therein.

The invention further comprises such a packaging liner and including a common back panel, joining said four partial panels, in pairs, and a back panel junction portion extending between respective pairs of said partial panels, and fold lines formed in said back panel junction portion whereby said two pairs of partial panels may be infolded one against the other.

The invention further comprises such a packaging liner and including a sleeve member adapted to slide over said liner and retain said at least one object therein.

The invention further comprises such a packaging liner and including a sleeve member adapted to slide over said liner and said four partial panels, and retain at least three said objects therein.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective illustration of a package for rectangular objects, embodying the invention, partially cut away to reveal its construction and containing a single rectangular object;

FIG. 2 is a section along the line 2—2 of FIG. 1;

DESCRIPTION OF A SPECIFIC EMBODIMENT

Figure 3:
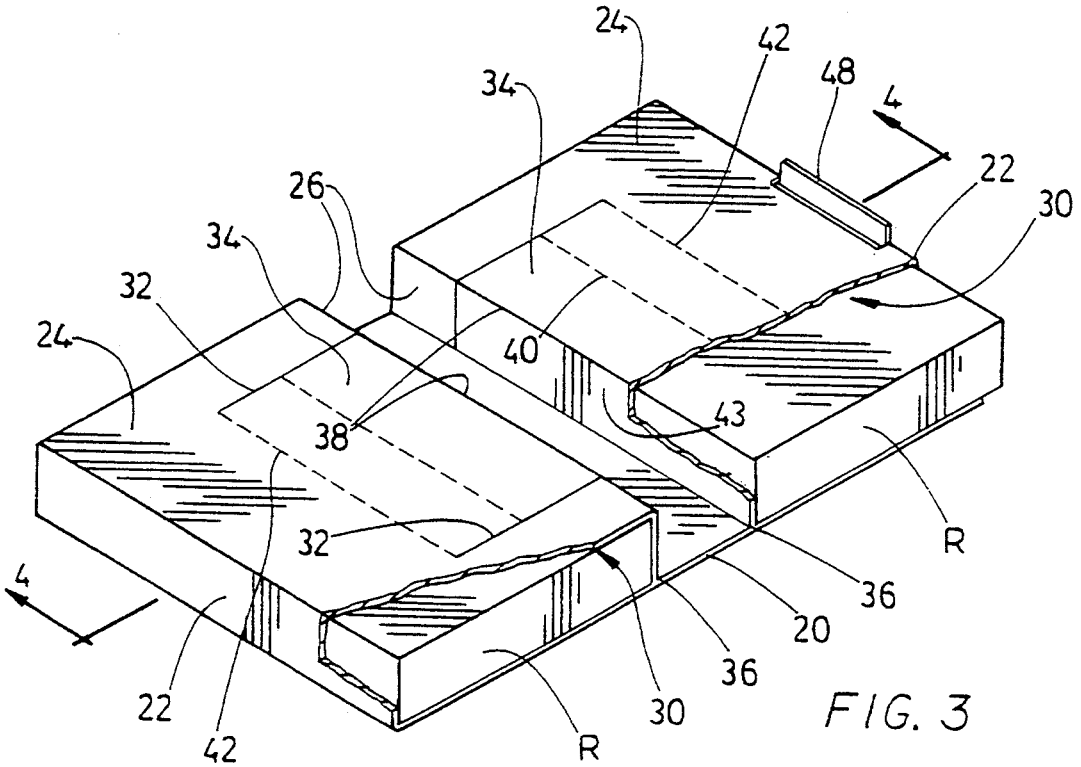
FIG. 3 is a perspective illustration of the package and the inner liner, partially cut away and shown holding two rectangular objects.

Referring first of all to FIG. 1, it will be seen that this illustration shows a package indicated generally as 10, which is a first illustrated embodiment of the invention. The package 10 is intended for containing either one or two rectangular objects indicated as R.

As mentioned above, the rectangular objects in this particular case are audio cassette tapes, which typically are contained in rectangular boxes, such as are well known in the art. The details of such tapes and boxes are not illustrated separately or separately referenced, since they are in any event well known. The rectangular object R may therefore be considered as representative of any such rectangular object, whether an audio cassette tape, or not, which it may be desired to package in a package containing one, or two such objects R.

However, as will become apparent from the following description, with certain modifications, the invention is applicable to the packaging of greater groups of such objects R. Illustrated and described below, there is a package suitable for packaging groups of either for example, three objects R or four such objects R. It will thus be understood that the invention is not limited solely to the packaging of a single article or two such articles, and these are illustration in FIGS. 1 to 9 merely by way of a first embodiment.

As shown in FIG. 1, the package indicating generally is 10, is of generally elongated rectangular shape which is considerably larger than the size of either one or two rectangular objects R.

This is desirable since rectangular objects such as audio cassettes are relatively small, and fit easily into a pocket or handbag. Consequently, if the audio cassettes are sold simply singly or loose, there is a significant rate of loss, due to pilfering on the like. The packaging of such objects in a larger oversize package is, therefore, desirable, since the larger package is found to reduce the loss rate. Oversized packaging of such objects also reduces simple losses of such objects becoming mislaid in the store. It also facilitates the in-store handling and labelling and displaying of such objects.

The package 10 consists of an outer tubular sleeve 12, and an inner liner indicated generally as 14. An outer transparent wrapper 16 is formed tightly around the sleeve 12 and liner 14. Wrapper 16 is of transparent, shrink wrapped thermoplastic material such as is well known in the art, and protects the sleeve 12 and liner 14 and holds them in a secure integral package.

The outer sleeve 12 consists of essentially a rectangular tubular shape, having front and back panels 12*a* and 12*b* and side panels 12*c*–12*c*. It is open at both ends for simplicity of construction, and this permits the liner 14 to be slid in from one end, in a manner to be described below.

As is apparent from this description, the liner 14 is secured within the sleeve 12, against axial sliding movement, by means of the outer wrapping 16.

As is apparent from FIG. 1, printed G material may be imprinted on any of the panels 12*a*–12*b*–12*c* of the sleeve 12.

The sleeve 12 is of simple construction and involves only a single glue seam. It will thus be appreciated that the sleeves 12 can be manufactured economically, and can be printed up with the necessary information and graphics, more or less at the time at which they are needed, and in volumes approximate to those expected to be sold, so as to avoid wastage.

The liners 14 are of more complex construction, as will become apparent from the following description, requiring two glue seams, and several cut lines, and several fold lines. They are thus more expensive to manufacture than the sleeves, and economical production of the liners can best be achieved by maximizing the production runs. However, as will become apparent from the following description, this is no objection since the liners themselves do no carry any printing or graphics and are consequently essentially "universal". In this way, it is possible to manufacture, for example, a sufficient supply of liners for a complete year's sales of a variety of different rectangular objects, (of the same shape), i.e., in this case, audio cassettes, and the liners can simply be stored in a warehouse, and released as required for various different cassettes, or objects. In FIGS. 1 and 2, this embodiment of the invention is illustrated, in use for packaging a single object R.

Figure 4:
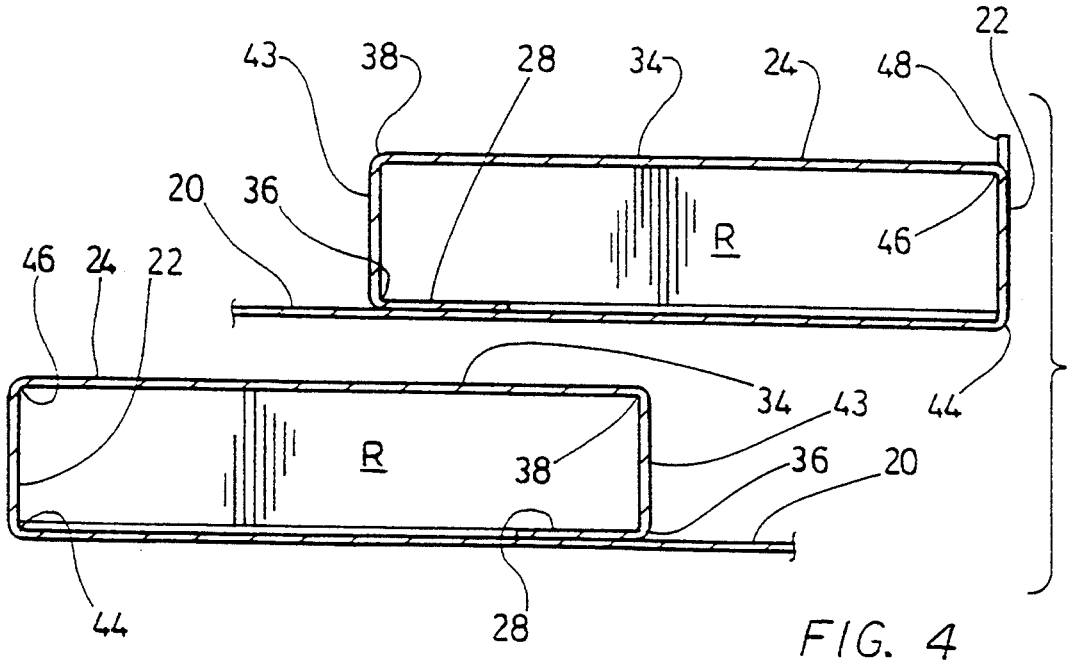
FIG. 4 is a section along the line 4—4 of FIG. 3.
Figure 5:
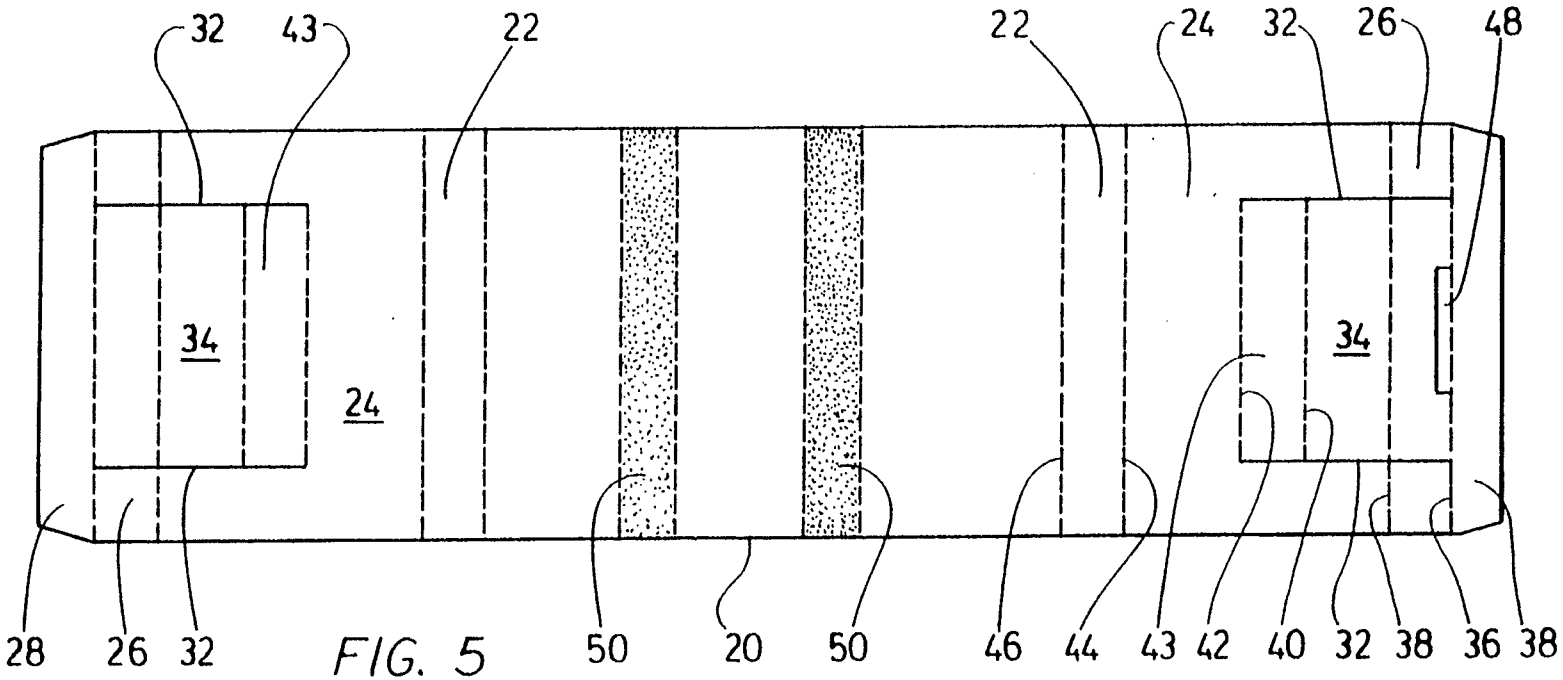
FIG. 5 is a schematic illustration of the blank of the liner showing the blank before gluing, and before being set-up for packaging.
Figure 6:
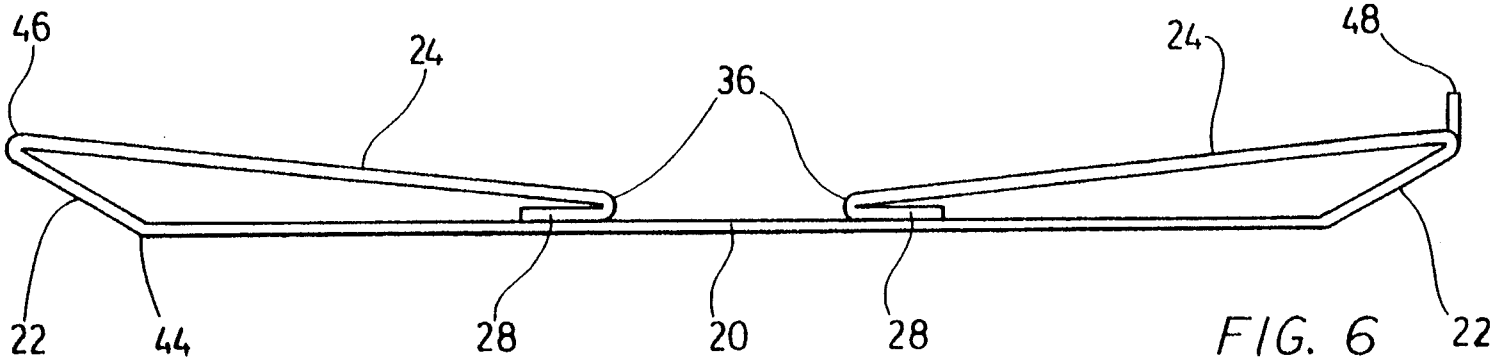
FIG. 6 is a side elevation of the blank of FIG. 5, after folding and gluing, but before set-up.
Figure 7:
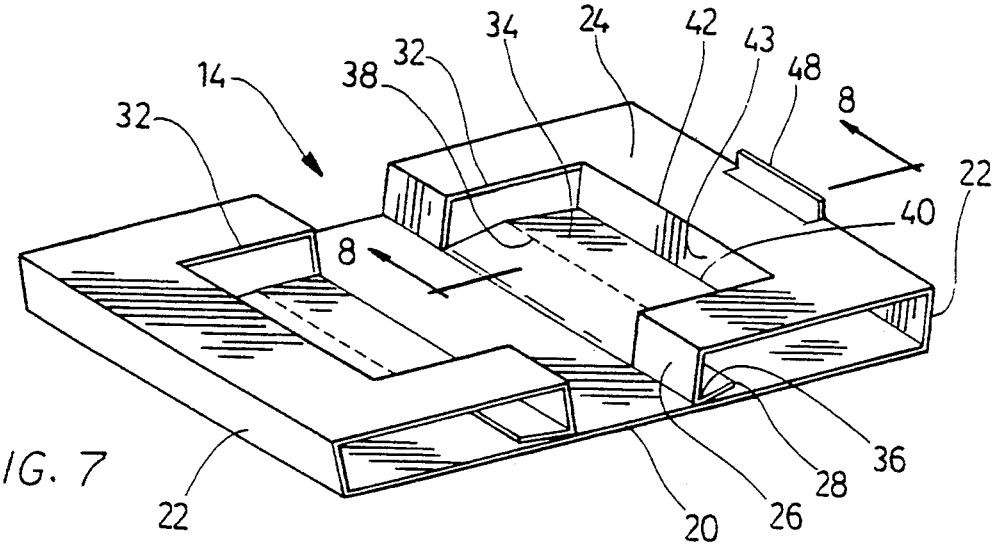
FIG. 7 is a perspective illustration showing the liner set-up to receive a single rectangular object.

Referring briefly to FIGS. 3 and 4, it will be seen that the same embodiment of the invention is there illustrated packaging two objects R.

The manner in which this is achieved will now become apparent.

Referring to FIGS. 1 and 2, the liner 14 will be seen to comprise a single continuous back panel 20, joined at each end to respective end panels 22 - 22.

Front partial panels 24 - 24 are joined to the free edges of end panels 22 - 22.

Partial wall panels 26 - 26 are joined to respective front panels 24 - 24.

Individual glue panels 28 - 28 are joined to partial wall panels 26 - 26. The respective glue panels 28 - 28 are glued to the back panel 20, in a particularly precise manner to be described below.

The back panels, end panels, front panels and partial wall panels thus enclose respective generally rectangularly shaped transverse tubular sleeves indicated as 30 -30, extending transversely of back panel 20.

Back panel 20 is so designed and cut as to have a width dimension W equal to the length of a rectangular object R, so that two such rectangular objects can be received therein transversely with respect to the back panel 20, in a manner to be described below in association with FIGS. 3 and 4.

In order to receive only a single rectangular object R, as illustrated in FIGS. 1 and 2, each of the front panels 24 - 24 is formed with two parallel spaced apart cut lines 32 - 32. The cut lines extend parallel to and spaced on opposite sides of the longitudinal axis of the back panel 20.

The cut lines 32 define, within the limits of each of the front panels 24, reduced width infold portions indicated as 34. Within the infold portions 34, transverse fold lines 36, 38, 40 and 42 are formed. Fold lines 40 and 42 define recess end panels 43.

The cut lines terminate at the edge of the glue panel 28, and are joined integrally thereto along the fold line o.

The cut lines 32 are spaced apart a distance substantially equal to the width dimension of a rectangular object R.

It will be noted that fold line 38 extends across both the infolding panel 34, in each case, and also across the full width of the front panel 24.

The two fold lines, 40 and 42 are shorter, and extend only across the width of the infold portions 34.

In addition to the above-mentioned fold line, panel 22 is joined to panel 20 by fold line 44, and to panel 24 by fold line 46.

An end tab 48 is struck out of panel 24 at one end of the liner, so as to limit insertion of the liner into the sleeve 12.

Figure 9:
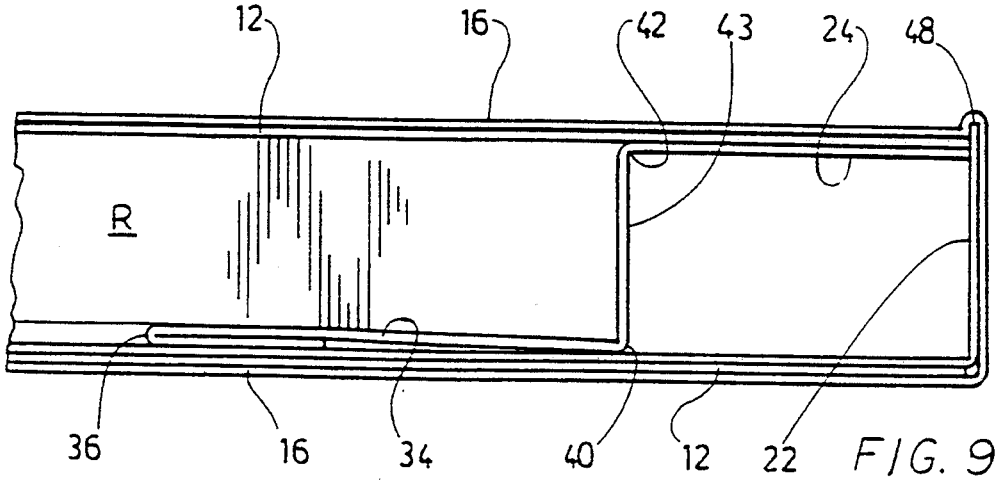
FIG. 9 is a section corresponding to FIG. 8 shown after insertion into an outer sleeve and after wrapping, and, FIG. 10 is a perspective illustration of an alternate embodiment of the invention, suitable for packaging three or four rectangular objects, in a single integral package.

Finally, as shown in FIG. 9, two glue strips 50-50 are located on blank 20 spaced apart from one another, to glue to flaps 28-28.

The fold lines 40 and 42 at the ends of the infold portions 34 are spaced apart a predetermined distance (to be described in greater detail below).

As illustrated in FIG. 1 and in FIG. 2, it will thus be seen that a single object R such as, in this case, an audio cassette, may be packaged in the liner 14. This is achieved by infolding the infold portions 34-34 in the two front panels 24-24. When infolded, the two infold portions leave two open sided generally rectangular recesses, each of which has a width dimension equal to the width of the object R, and which, together, define a length spacing (between panels 43-43), substantially but not quite equal to the length of an object R, for reasons to be described below. A single rectangular object R may thus be placed in the two rectangular recesses defined by infolded portions 34-34, and the liner 14 and object R may then be slid into their sleeve 12, and wrapped.

Figure 8:
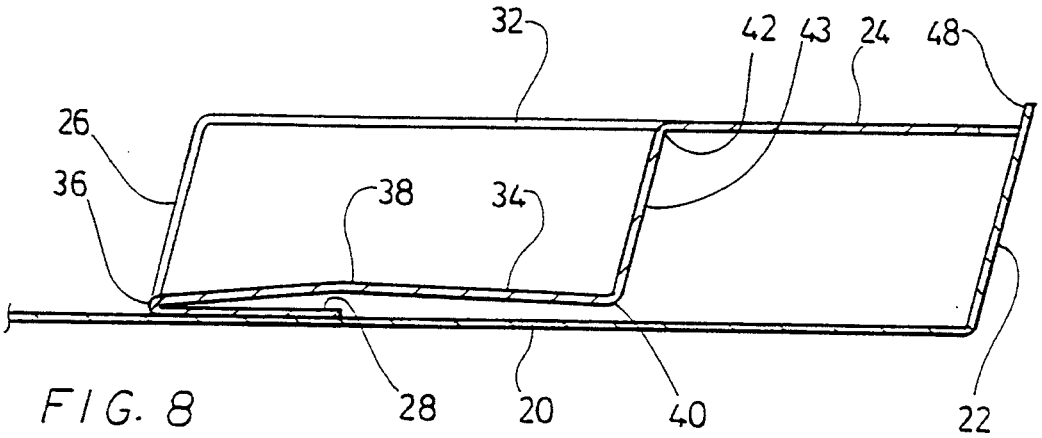
FIG. 8 is a sectional illustration of one end of a liner along line 8—8 of FIG. 7, prior to insertion into the outer sleeve, and prior to wrapping.

The end walls 43 are defined by means of the fold lines 40 and 42, and the locations of the glue strips 50-50 are designed, so that when set-up, but prior to insertion of an object R (FIG. 8), the walls 43, together with the end panels 26, and the junction panels 22, all adopt an oblique angle orientation as illustrated in FIG. 8. The distance between the lower fold line 40 of each of the walls 43, is just less than the length of a rectangular object R.

When finally set-up (FIG. 9) and inserted into a sleeve, and when the exterior wrapper 16 is applied tightly around the package, the walls 43, being connected to the panels 22, will then be squeezed tightly against the opposite ends of the rectangular object R, and the walls 43 and 22 will then adopt a generally rectangular configuration (as shown in FIG. 9).

It will thus be seen that by the use of a package having this particular geometry and configuration, a liner 14 may be provided which is capable of either packaging a single object R, or may receive two such objects R, and that either way, the liner may be inserted into a sleeve 12 of standard dimension. Printing and graphics will usually be printed, for example, on the cassette tape itself. However, this will normally be invisible in the package unless there is a window in the sleeve 12. Appropriate graphics (FIG. 1) can be printed on the sleeve 12 wherever desired, without the need for printing on the liner 14 itself.

Figure 10:
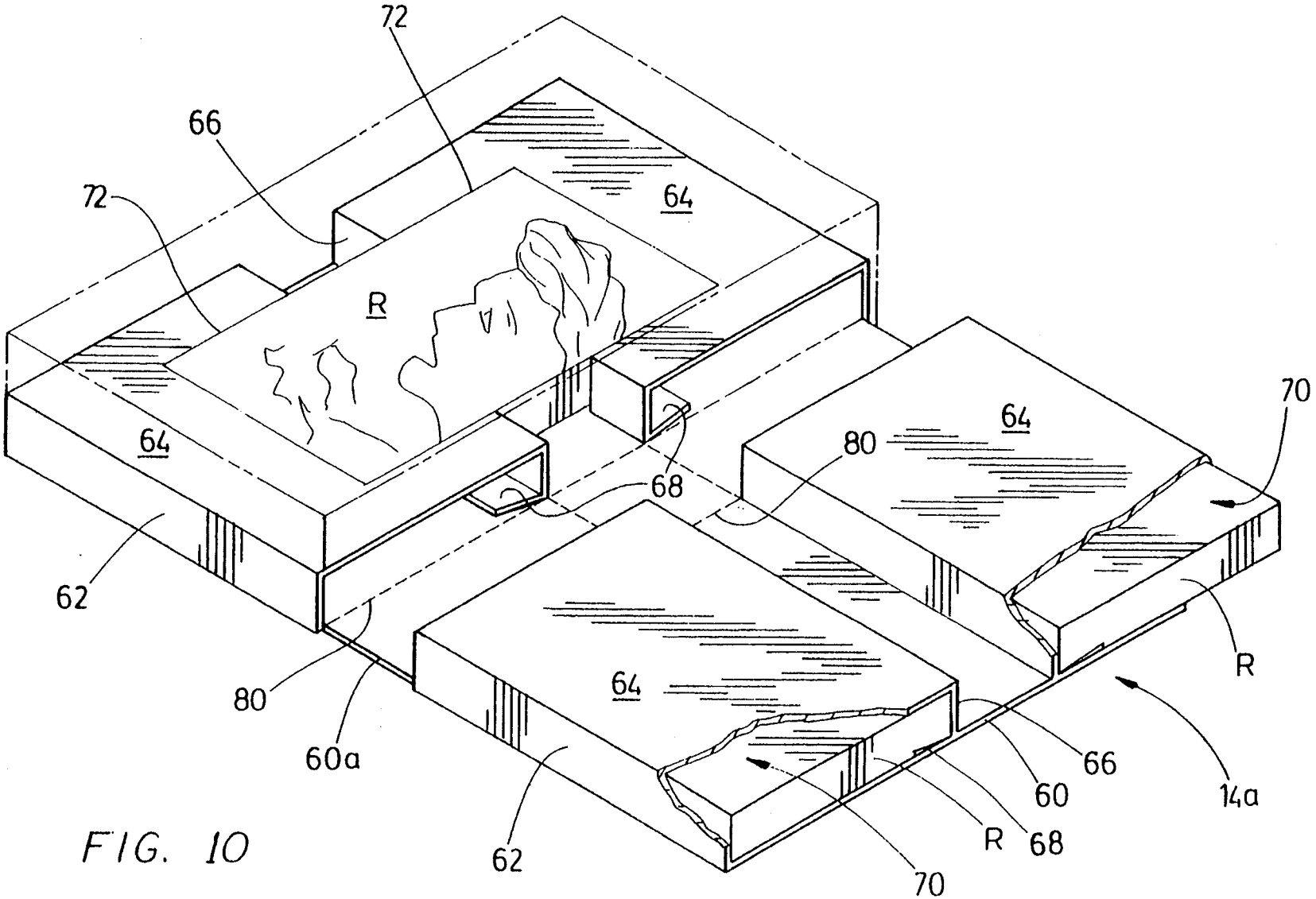

In accordance with a further embodiment of the invention illustrated in FIG. 10, provision may be made for packaging a greater number of objects R.

In this case, a modified form of liner **14*a*** is illustrated.

The liner **14*a* is designed and intended for packaging either three, or four rectangular objects R. As illustrated in FIG. 10, three such rectangular objects R are shown packaged in the modified liner 14A**.

It will, however, be appreciated that as following description proceeds, the modified liner **14*a* can in theory at least, also be used for packaging a single object R, or two such objects R, if that were required. In practice, this is unlikely since the liner 14 of FIGS. 1 to 9 is more economical to produce, and therefore, it is unlikely that circumstances would arise where it was desirable to use the more complex liner 14*a* of FIG. 10** to package only one or two such objects.

The modified liner **14*a* comprises a back panel 60, being formed with four end panels 62, four front partial panels 64, and four partial wall panels 66 and four glue panels 68. Each of the four end panels, front panels, and partial walls together with the back panel define four separate transverse rectangular recesses 70. Each of the recesses 70 is long enough transversely to receive an object R, in this case, an audio cassette. Thus four objects R can be packaged in liner 14*a***, although only three are shown, for purposes of illustration.

In order to receive a smaller number of objects R, two of the front panels 64 are formed with cut lines 72, and the same fold lines as in the embodiment of FIGS. 1 to 9. In this way, the infolded portions (not shown) defined by the cut lines 72 and the folds lines (not numbered) permit a single object R to packaged on one side, and two objects R to packaged on the other side of the liner **14*a***, thus providing for the packaging of three such objects R.

The back panel 60 extends continuously, to form a junction panel **60*a*, and a fold lines 80 extends up either side of panel 60*a***.

The junction panel **60*a* has a width equal to not less than twice the thickness of the rectangular objects R. In this way, the junction panel 60*a* can be folded along the lines 80, and bring the two halves of the liner 14*a*** together, somewhat in the manner of book.

The arrangement of the various folds lines and glue strips follows the same geometry as that illustrated in FIGS. 5, 6, 7, 8, and 9. Thus in the event that the infolded portions are indented so as to receive a single object R (as shown), when the liner **14*a*** is then inserted into a sleeve (not shown) and wrapped with suitable wrapping (not shown) that object R will thus be gripped tightly end for end, in a manner described above.

Without infolding panels 64, the four separate chambers can receive four separate objects R.

If desired, for two objects R, infolded portions can be provided in all of the front partial panels 64, although, as noted this usage is unlikely.

Clearly, the sleeve (not shown) used for the liner **14*a* will be of made of depth dimension twice that of the sleeve 12 of FIG. 1, so that it can receive the thicker liner 14*a***.

Otherwise, the other aspects of the embodiment of FIG. 10 are similar to those of FIGS. 1 through 9.

The use of the invention is self-evident from the foregoing description.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A packaging liner for use in association with objects of pre-determined length, breadth and depth, for holding at least one said object in a secure manner, and comprising:

a back panel defining a length greater than the length of a said object, the length defining a longitudinal direction of the liner and defining a width greater than the width of said object and equal to the length of said object, the width defining a transverse direction of the liner;

an end panel on each end of said back panel;

a partial panel connected to each said end panel, and adapted to overlie portions of said back panel and defining a free end;

a glue flap on said free end of each of said partial panels, and adapted to be glued in a pre-determined locations to said back panel, whereby to secure said partial panels in said overlying relation over said back panel;

two parallel spaced apart transverse chambers defined by respective partial panels, and said back panel, each of said transverse chambers being shaped and dimensioned to receive a respective said object therein;

foldable panel portions in each of said partial panels, each said foldable panel portion being adapted to be folded into its respective one of said chambers to define an open-sided recess, each of said recesses defining a transverse direction dimension equal to the width of a said object, and defining a longitudinal direction dimension less than that of a said object, whereby portions of one said object may be received in respective said open-sided recesses, and secured therein lengthwise with respect to said back panel, and, transverse fold lines in said foldable panel portions defining fold bottom walls, and fold end walls, said fold end walls being connected to said partial panels, and said fold bottom walls being secured to said back panel.

2. A packaging liner as claimed in claim 1, and including partial wall panels connected to said partial panels and to said glue flaps, and fold lines between said back panel and said end panels and between said end panels and said partial panels and between said partial panels and said partial panel glue flaps, whereby said liner may be stored in a substantially flat extended condition, and whereby folding along said fold lines will set up said liner.

3. A packaging liner as claimed in claim 2, wherein said partial panels define a predetermined length and breadth, and wherein each of said glue flaps is glued to said back panel a predetermined distance from a respective said end panel, said predetermined distance being less than said length of said partial panels.

4. A packaging liner as claimed in claim 1, and wherein said recesses are of open-sided rectangular shape, and wherein each recess defines an end, said ends being spaced apart a distance less than the length of a said object.

5. A packaging liner as claimed in claim 1, and wherein each said foldable panel portion defines spaced apart parallel side cuts, said side cuts extending longitudinally with respect to said back panel, and said fold lines extending between said side cuts, generally normal thereto.

6. A packaging liner as claimed in claim 1, and including four said partial panels connected to respective said end panels, and respective glue flaps therefor, each of said partial panels defining respective said chambers, whereby said packaging liner may receive at least three said objects.

7. A packaging liner as claimed in claim 6, wherein at least two of said four partial panels define respective foldable panel portions, being adapted to be folded to define respective open-sided recesses whereby a said object may be received therein.

8. A packaging liner as claimed in claim 7, and including a common back panel, joining said four partial panels, in pairs, and a back panel junction portion extending between respective pairs of said partial panels, and fold lines formed in said back panel junction portion whereby said two pairs of partial panels may be infolded one against the other.

9. A packaging liner as claimed in claim 6, and including a sleeve member adapted to slide over said liner and said four partial panels, and retain at least three said objects therein.

10. A packaging liner as claimed in claim 1, and including a sleeve member adapted to slide over said liner and retain said at least one object therein.

* * * * *